United States Patent [19]

Matsuo

[11] 4,186,290

[45] Jan. 29, 1980

[54] PUSH BUTTON SWITCH

[75] Inventor: Katsuyuki Matsuo, Iwaki, Japan

[73] Assignee: Alps Electric Co., Ltd., Tokyo, Japan

[21] Appl. No.: 973,442

[22] Filed: Dec. 26, 1978

[30] Foreign Application Priority Data

Dec. 30, 1977 [JP] Japan ..... 52/178315
Feb. 10, 1978 [JP] Japan ..... 53/15745

[51] Int. Cl.[2] ..... H01H 13/14; H01H 13/38

[52] U.S. Cl. ..... 200/159 A; 200/16 R; 200/67 DA; 200/153 LA; 200/283

[58] Field of Search ..... 200/67 D, 67 DA, 67 DB, 200/76, 153 L, 153 LA, 159 R, 159 A, 283, 16 R, 16 B, 16 D

[56] References Cited

U.S. PATENT DOCUMENTS

| | | | |
|---|---|---|---|
| 2,301,874 | 11/1942 | Hetherington | 200/67 DA X |
| 2,420,880 | 5/1947 | Hetherington | 200/67 DA X |
| 2,524,411 | 10/1950 | Trainor | 200/67 D |
| 2,583,756 | 1/1952 | Wahlberg | 200/67 D |
| 3,708,635 | 1/1973 | Cosley et al. | 200/16 R X |
| 3,787,653 | 1/1974 | Maher | 200/153 LA X |
| 3,965,320 | 6/1976 | Ditzig | 200/159 A X |
| 4,129,764 | 12/1978 | Ohkita et al. | 200/159 R |

FOREIGN PATENT DOCUMENTS

| | | | |
|---|---|---|---|
| 805683 | 12/1958 | United Kingdom | 200/67 DA |

*Primary Examiner*—Stephen Marcus
*Attorney, Agent, or Firm*—Guy W. Shoup; Gerard F. Dunne

[57] ABSTRACT

A push button switch having a plurality of fixed terminals and an inversion leaf spring member opposing the fixed terminals. The inversion leaf spring member is adapted to be actuated by an actuator lever pivotally supported by a switch block which is adapted to extend in parallel with the direction of movement of a switch lever. A coiled spring is disposed between the actuator lever and the switch lever.

11 Claims, 10 Drawing Figures

PUSH BUTTON SWITCH

BACKGROUND OF THE INVENTION

1. Field of the Invention

The present invention relates to a push button switch and, more particularly, to a push button switch suitable for use in a terminal machine of a computer or in an electric typewriter.

2. Description of the Prior Art

Generally speaking the push button switch of the kind mentioned above has, as disclosed in the specification of U.S. Pat. No. 3,969,600, an inversion leaf spring member made of a thin plate of beryllium copper or the like material is disposed on the bottom plane so as to extend in a horizontal plane. In operation, the inversion leaf spring member is inversed as it is depressed vertically by a depression of key top, so as to bring the movable contact into contact with a fixed contact, thereby to close the switch.

This switch however has disadvantages such as a limited stroke of the keytop. In addition, the contact mechanism is so weak that it may be broken by a large depressing force exerted on the key top.

In order to avoid the breakage of the contact mechanism, U.S. Pat. No. 3,773,998 proposes a push button switch incorporating a coiled spring. This switch, however, cannot provide a distinctive feel to the user of the switch.

SUMMARY OF THE INVENTION

It is therefore an object of the present invention to provide a push button switch capable of affording a light switching operation and yet provide a distinctive feel to the user of the switch.

It is another object of the present invention to provide a push button switch which allows an optional selection of the stroke of switch lever to some extent, and which is free from the problem of breakage of the contact mechanism.

It is still another object of the present invention to provide a push button switch in which the frame of the switch has a space ample enough to accomodate, as required, a plurality of contact mechanisms.

To these ends, according to the present invention, there is provided a push button switch comprising a plurality of fixed terminals, an inversion leaf spring member provided to be opposed to the fixed terminals, an actuator lever for actuating said inversion leaf spring member and pivotally supported by a switch block, the switch block extending in parallel with the direction of movement of the switch lever, and a coiled spring disposed between the switch lever and the actuator lever.

The push button switch may be provided with two contact mechanisms housed by its frame, such that the depression strokes of the switch lever for operating these contact mechanisms are different. At the same time, these contact mechanisms are adapted to be operated with different magnitudes of power. According to this arrangement, the push button switch can perform two different functions.

DESCRIPTION OF THE PREFERRED EMBODIMENT

Figure 1:
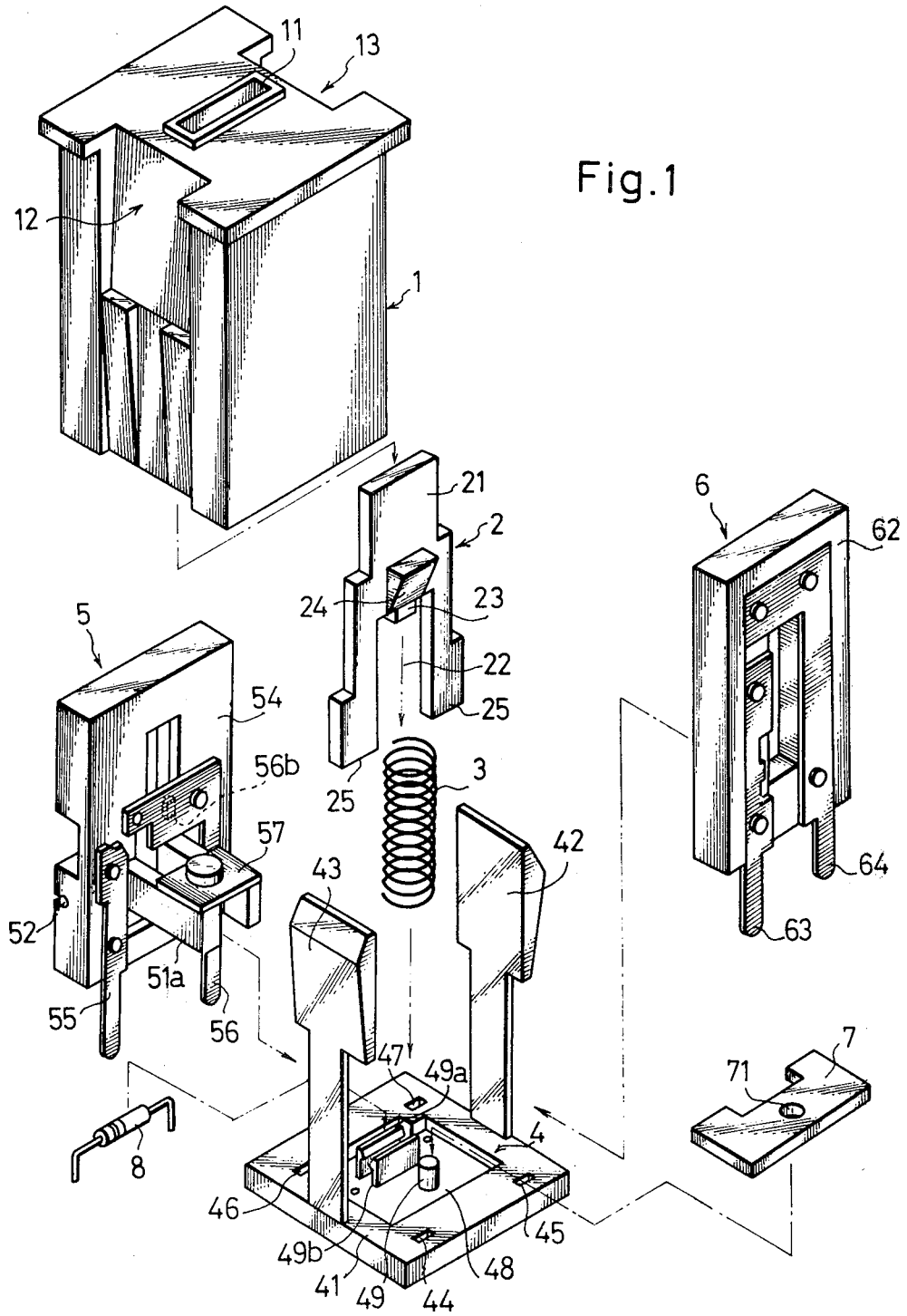
FIG. 1 is an exploded perspective view of an embodiment of the present invention.

Referring to FIG. 1 which is an exploded perspective view of an embodiment of the invention, a case 1 is provided with a slit 11 formed in its upper surface, as well as a pair of retaining grooves 12, 13. A switch lever 2 is provided at its upper end with a projection 21 to which a push button is adapted to be fitted, and at its lower portion with a groove 22. The switch lever further has a spring retaining portion 23 formed at the upper end of the groove 22 and an actuating projection 24 formed at its one side. Reference numerals 3 and 4 denote, respectively, a coiled spring and a lower case. Retaining tabs 42 and 43 are formed at both sides of a bottom plate 41 of the lower case. The bottom plate 41 is provided with rectangular bores 44, 45, 46 and 47 adapted to loosely receive terminals of later-mentioned two contact mechanisms, and a central recess 48. A columnar projection 49 and diode retaining pieces 49*a*, 49*b* are formed on the bottom plate 41 within the area of the central recess 48. Reference numerals 5 and 6 denote contact mechanisms adapted to perform different switching functions. These mechanisms will be described later in more detail. A rubber seat 7 has a retaining bore 71. Reference numeral 8 denotes an accessory diode.

Figure 2:
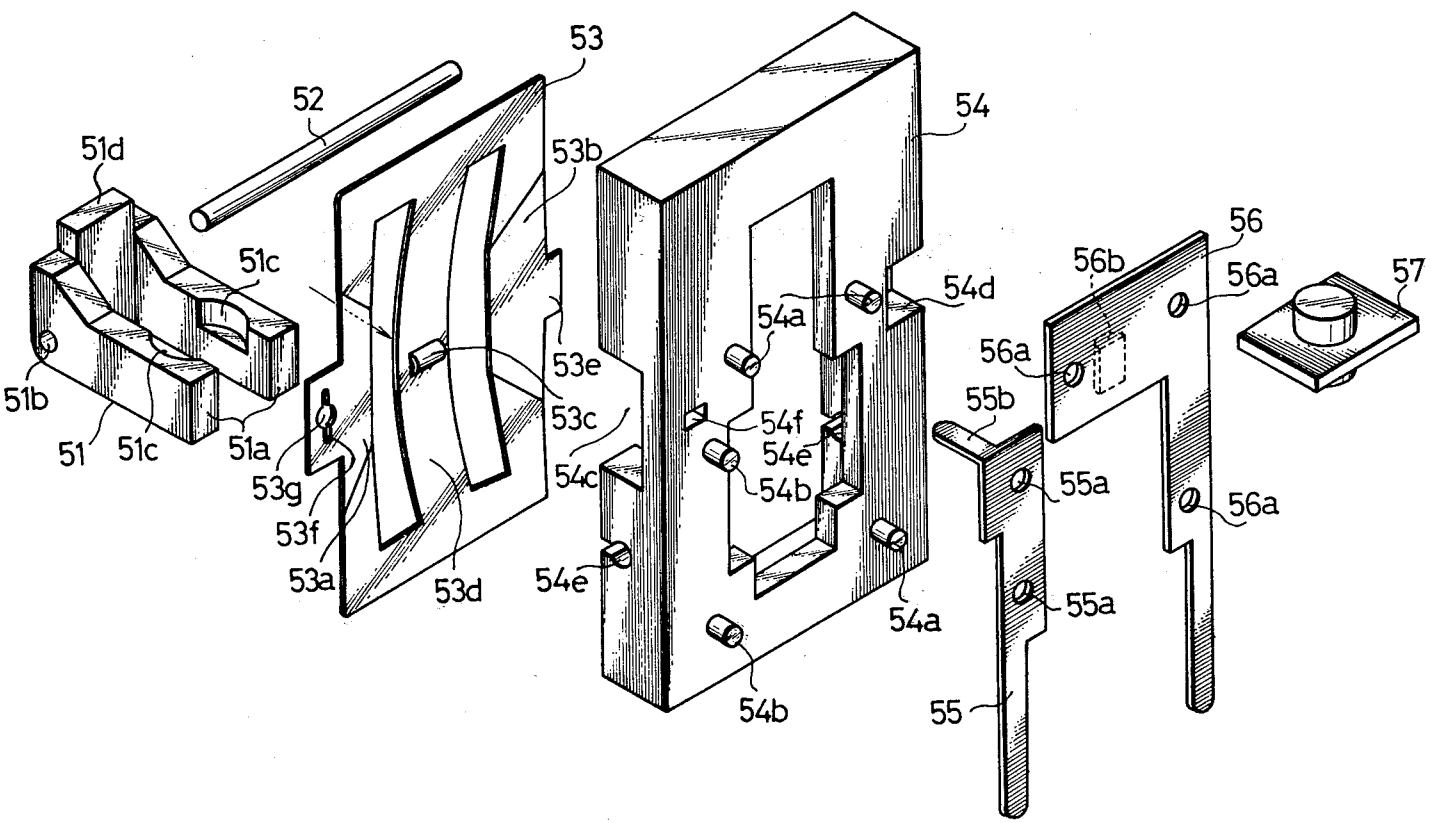
FIG. 2 is an exploded perspective view of a first switch block incorporated in the embodiment as shown in FIG. 1.

As shown in FIG. 2, the contact mechanism 5 has an actuator lever 51, shaft 52, inversion leaf spring member 53, carrier plate 54, first terminal 55, second terminal 56 and a spring retainer 57 made of rubber.

The actuator lever 51 consists of legs 51*a*, bore 51*b*, recesses 51*c* and a back portion 51*d*. The inversion leaf spring member 53 is made of a thin plate of beryllium copper, and has frame portions 53*a*, 53*b*, movable contact 53*c*, movable plate 53*d*, tab 53*e* and a tab 53*f* provided with a bore 53*g*. In press-forming the inversion leaf spring member 53, the frame portions 53*a* and 53*b* are so bent that the movable plate 53*d*, to which the movable contact 53*c* is attached, is bent in an arcuate form. The movable plate 53*d* is adapted to be inversed as it is pressed and moved in the direction of the arrow, by a predetermined distance. At the time of this inversion, a distinctive click sound is generated by the movable plate 53*d*. Similarly, as the movable plate 53*d* is released from the depressing force, it comes to resume the original position, making a click sound. The carrier plate is provided with projections 54*a*, 54*b*, recesses 54*c*, 54*d*, a bore 54*e* and a rectangular 54*f*. The first terminal 55 has a small bore 55*a* and a bent end 55*b*, while the second terminal 56 has a small bore 56*a*, and a fixed contact 56*b*.

The contact mechanism 5 is adapted to be assembled in the following manner. At first, the second terminal 56 is attached to the carrier plate 54 by inserting the projection 54*a* of the carrier plate 54 into the small bore 56*a* and then heat-deforming the end of the projection 54*a*. At the same time, the first terminal 55 is attached to the carrier plate 54 by inserting the projection 54*b* of the carrier plate and the bent end 55*b* of the first terminal into the small bore 55*a* of the first terminal 55 and the rectangular bore 54*f* of the carrier plate 54, respectively, and then heat-deforming the end of the projection 54*b*.

Subsequently, the tabs 53*e* and 53*f* of the inversion leaf spring member 53 are fitted into the recesses 54*c* and 54*d* of the carrier plate 54. Consequently, the end 55*b* of the first terminal 55 which projects into the recess 54*c*, is made to pass through the bore 53*g* of the tab 53*f*. Then, the end 55*b* is bent or twisted so that the inversion leaf spring member 53 and the first terminal 55 are electrically connected to each other.

Then, after inserting the legs 51*a* of the actuator lever 51 into the slits between the frame portions 53*a*, 53*b* and the movable plate 53*d* of the inversion leaf spring member 53, the shaft 52 is inserted into the bore 54*e* of the carrier plate 54 and into the bore 51*b* of the actuator lever 51, thereby to pivotally attach the actuator lever 51 to the carrier plate 54. Finally, the spring retainer 57 made of rubber is fitted to the recesses 51*c* of the legs 51*a* of the actuator lever 51.

Figure 3:
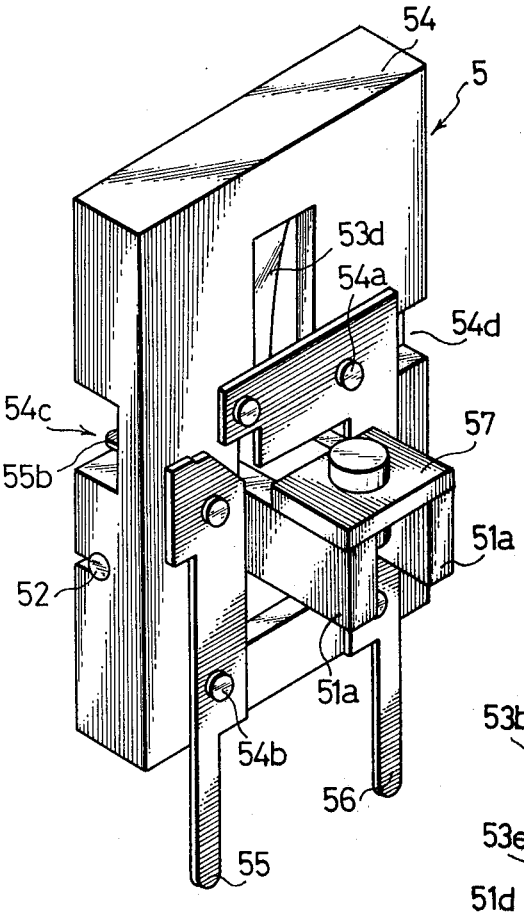
FIG. 3 is a perspective view of the first switch block as shown in FIG. 2.
Figure 4:
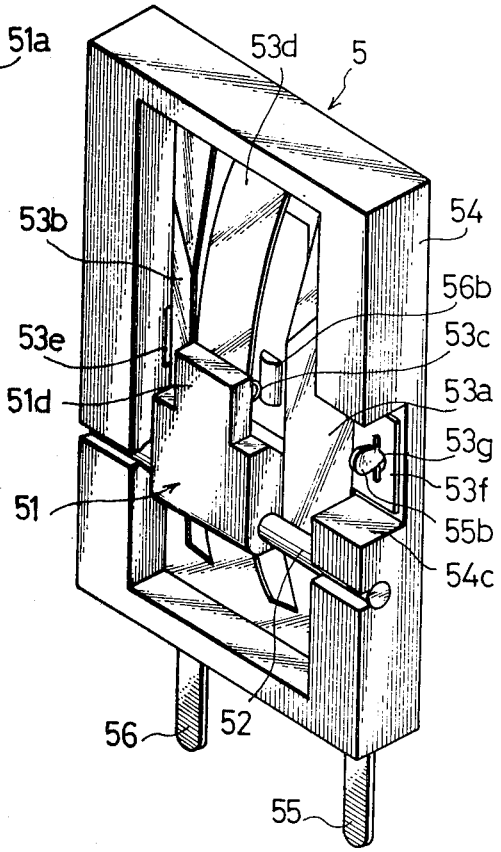
FIG. 4 is a perspective view of the first switch block as shown in FIG. 3, as viewed from the rear side thereof.

FIGS. 3 and 4 are perspective views of the contact mechanism 5 in the assembled state, as viewed from the front and rear side, respectively.

Figure 5:
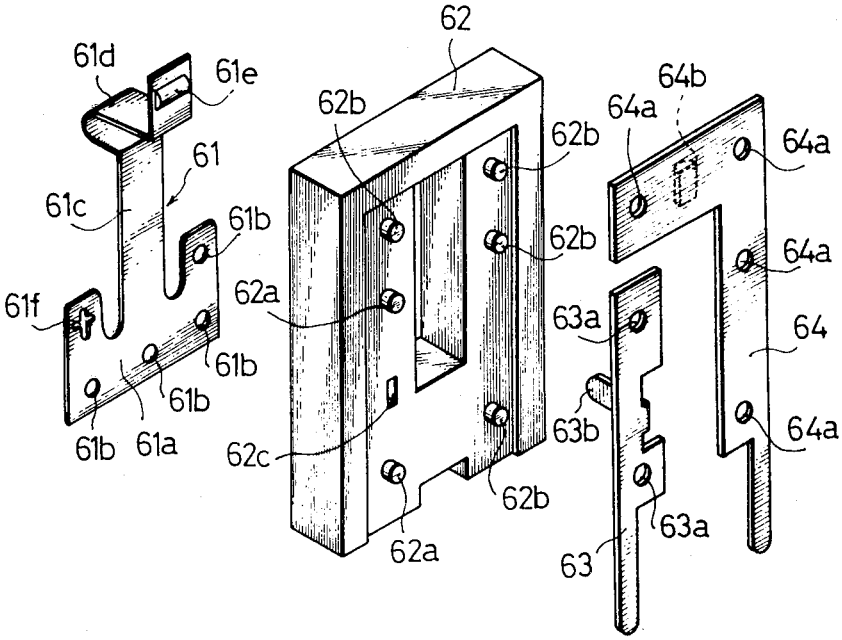
FIG. 5 is an exploded perspective view of a second switch block incorporated in the embodiment shown in FIG. 1.

Another contact mechanism 6 has, as shown in FIG. 5, a movable leaf srping 61, carrier plate 62, first terminal 63, and a second terminal 64. The movable leaf spring 61 is made of a thin plate of beryllium copper punched out of a blank, and has small bores 61*b* and a cross-shaped bore 61*f* formed in its base portion 61*a*.

The central contact portion 61*c* is bent at its upper end portion to form a U-shaped portion 61*d*. The extreme end of the U-shaped portion is bent to extend upward and carries a movable contact 61*e*. The carrier plate 62 is provided at its one side with projections 62*a* and 62*b*, and at its other side with a projection (not shown) for fixing the movable leaf spring. The carrier plate 62 further has a rectangular bore 62*c*.

The first terminal 63 is provided with small bores 63*a* and an end portion 63*b*, while the second terminal 64 is provided with small bores 64*a* and a fixed contact 64*b*.

Figure 6:
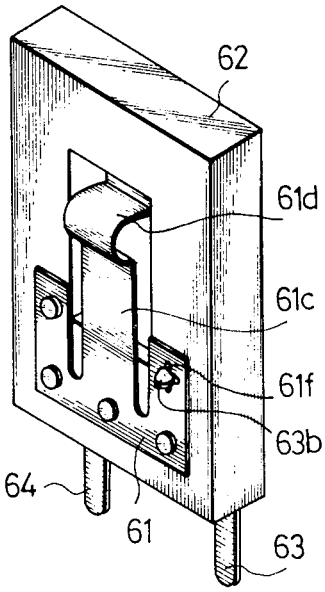
FIG. 6 is a perspective view of the second switch block as shown in FIG. 5.

The contact mechanism 6 is assembled in the following manner. At first, the second terminal 64 is fixed to the carrier plate 62, by inserting the projections 62*b* of the carrier plate 62 into the small bores 64*a* of the second terminal 64, and then heat-deforming the end of the projections 62*b*. At the same time, the first terminal 63 is attached to the carrier plate 62 by inserting the projection 62*a* of the carrier plate 62 and the end 63*b* of the first terminal 63 into the small bores 63*a* of the first terminal 63 and the rectangular bore 62*c* of the carrier plate 62, respectively, and then heat-deforming the ends of the projections 62*a*. Subsequently, the movable leaf spring 61 is attached to the carrier plate 62. This is done by at first inserting projections (not shown) formed on the opposite side of the carrier plate 62 from the first and second terminals into the small bores 61*b* of the movable leaf spring 61, and then heat-deforming the ends of the projections. Then, the end 63*b* of the first terminal 63, projected through the cross-shaped bore 61*f* of the movable leaf spring 61, is bent or twisted so as to electrically connect the movable leaf spring 61 and the first terminal 63 to each other. In FIG. 1, this contact mechanism is shown in a perspective view as viewed from the front side, while FIG. 6 is a perspective view of the contact mechanism as viewed from the rear side.

Hereinafter, a description will be made as to how the push button switch of the invention is assembled, with reference to FIG. 1.

At first, a diode or other electrical component 8 is inserted into the space between the retaining pieces 49*a* and 49*b* formed in the recess 48 of the lower case 4. Then, the projection 49 is inserted into the retaining bore 71 of the rubber seat 7, so that the rubber seat 7 comes to be received by the recess 48 of the lower case 4.

Then, after inserting the first and second terminals 55, 56 of the contact mechanism 5 into rectangular bores 46, 47 formed in the bottom plate 41 of the lower case 4, these terminals are caulked at the downside surface of the bottom plate 41, so that the contact mechanism 5 is fixed to the lower case 4.

Then, the coiled spring 3 is placed on the rubber spring retainer 57 of the contact mechanism 5, and the switch lever 2 is mounted on the coiled spring 3 such that the coiled spring 3 is received by the groove 22 of the switch lever 2. In this state, the spring retaining portion 23 provided at the upper end of the groove 22 of the switch lever 2 engages the upper end of the coiled spring 3.

Finally, the case 1 is put on the lower case 4, such that the retaining grooves 12, 13 of the case 1 are engaged by the retaining tabs 42, 43 of the lower case 4. In this state, the projection 21 of the switch lever 2 projects out of the slit 11 of the case 1.

Figure 7:
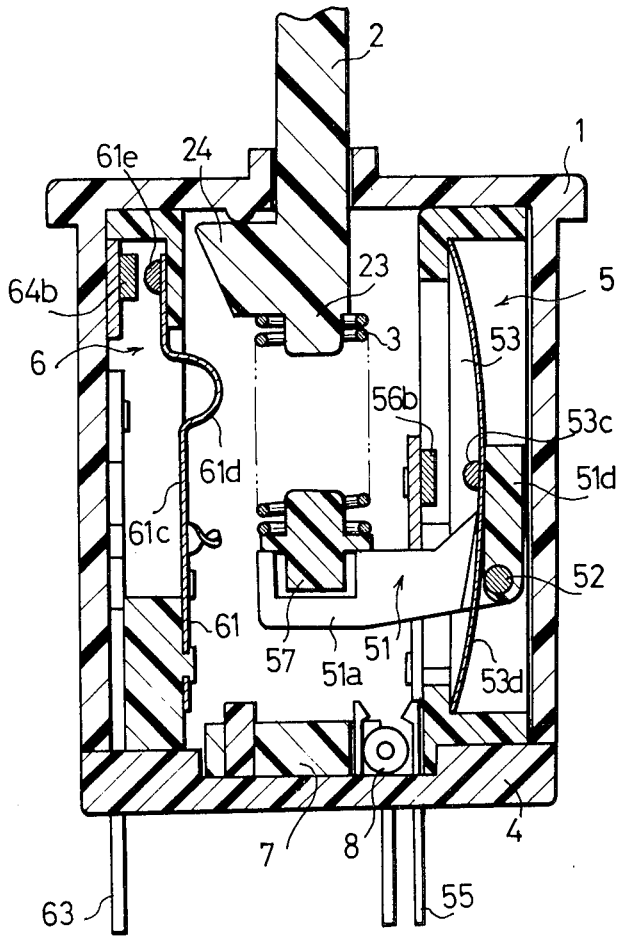
FIG. 7 is a sectional view of embodiment of the FIG. 1.

FIG. 7 shows in section the push button switch in the assembled state.

Hereinafter, the operation of the push button switch in accordance with the present invention will be described.

As the projection 21 of the switch lever 2 is depressed downward, the coiled spring 3 is compressed, so that the pressing force is transmitted to the spring retainer 57 made of rubber, thereby to depress the legs 51*a* of the actuator lever 51 downward. Consequently, a pressing force is applied to the movable plate 53*d* of the inversion leaf spring member 53, through the actuator lever 51. However, the inversion leaf spring member 53 is not inversed until the depressing force comes to exceed a predetermined threshold, because the coiled spring 3 is compressed to absorb the depressing force. As the force exerted by the back portion 51*d* of the actuator lever 51 on the movable plate 53*d* of the inversion leaf spring member 53 grows large enough to cause the inversion of the latter, the inversion leaf spring member 53 is inversed generating a click sound, so that a light feel of click is transmitted to and sensed by the operator's hand. Thus, the movable contact 53*c* is brought into contact with the fixed contact 56*b*, and the contact mechanism 5 is turned on.

Then, as the depressing force on the switch lever 2 comes to be weakened, the coiled spring 3 commences to expand. However, the inversion leaf spring member 53 is kept in the inversed position, until the force exerted by the back portion 51*d* of the actuator lever 51 is weakened enough to allow the self-resetting of the inversion leaf spring member 53. Till then, only the lever 2 is moved upward, allowing the coiled spring 3 to expand. Then, as the pressing force on the movable plate 53*d* is reduced to a predetermined threshold, the inversion leaf spring member 53 is returned to the original posture, generating again a click sound. Thus, the movable contact 53*c* is moved away from the fixed contact 56*d* to turn the contact mechanism into "off" state, which is confirmed through a light feel of click transmitted to the operator's hand.

Thus, the motion of the contact mechanism 5 in the first region includes such a hysteresis, due to the combined action of the coiled spring 3 and the inversion leaf spring member 53, that the position of the lever at which the contact mechanism is turned on is different from that at which the contact mechanism is turned off. This hysteresis operation is illustrated by full-line in FIG. 8.

Figure 8:
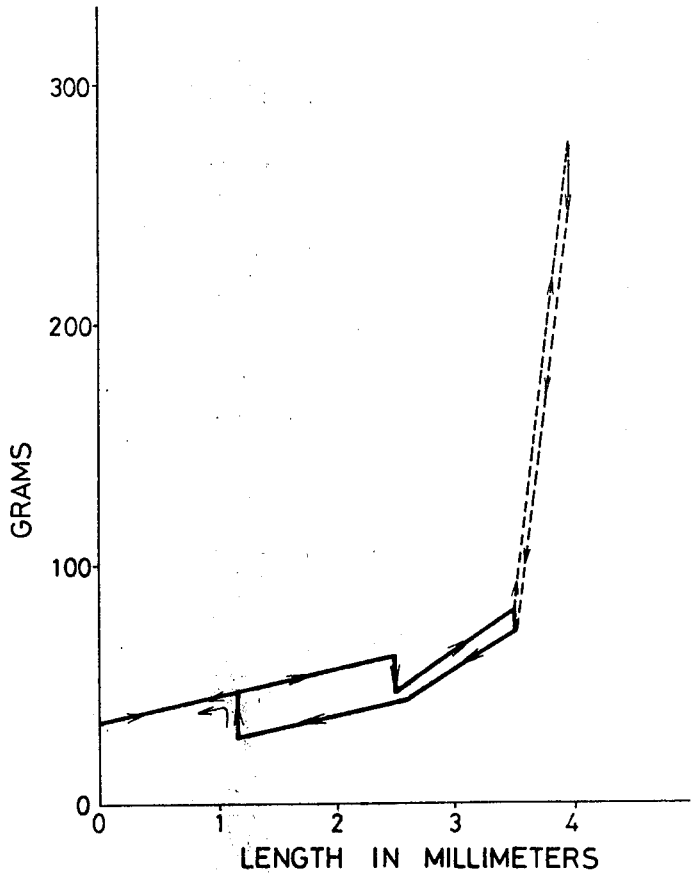
FIG. 8 is a drawing for explaining the operation of the embodiment of the present invention.

When, the contact mechanism 5 is kept in the on state by the depression of the switch lever 2, the lower end 25 of the lever 2 is in slight contact with the surface of the rubber seat 7. In this state, as the lever 2 is further depressed without being loosened, the lower end 25 of the lever 2 strongly presses the rubber seat 7 to deform the latter, so as to allow the depression of the lever 2. Then, as the lever 2 is fully depressed, the operating projection 24 formed at the side of the lever 2 comes into contact with the U-shaped portion of the movable leaf spring 61 of the contact mechanism 6, so as to move the same. Consequently, the movable contact 61*e* provided at the end of the movable leaf spring 61 is brought into contact with the fixed contact 64*b*, so that the contact mechanism is turned on. As the large depressing force on the lever 2 is suspended, the lever 2 is moved upward by the restoring force of the rubber seat 7, so that the actuating projection 24 clears the U-shaped portion to turn the contact mechanism 6 off. In FIG. 8, the broken line curves shows the operation of the push button switch of the invention in the second region, in which the contact mechanism 6 is turned on and off.

Figure 9A:
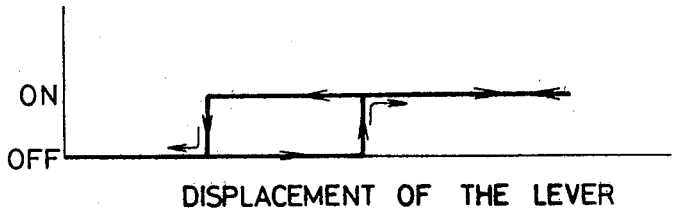
FIG. 9 is another drawing for explaining the operation of the embodiment of the present invention.
Figure 9B:
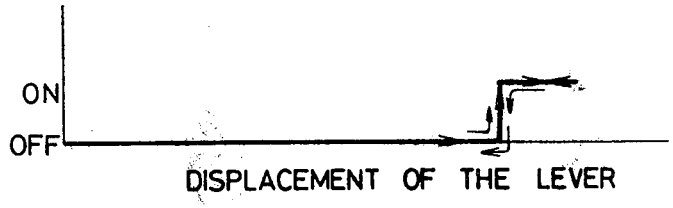

FIGS. 9A and 9B shows the states of the contact mechanisms 5 and 6 in relation with the position of the lever 2.

The stroke of the switch lever for actuating the switches can be adjusted to some extent, by selecting the force of the coiled spring 3 suitably.

What is claimed is:

1. A push button switch comprising:

a frame;

a switch lever;

a switch block accomodated by said frame and including, (a) a carrier plate, (b) an inversion leaf spring member made of an electrically conductive material and attached to said carrier plate so as to extend in parallel with the direction of the movement of said switch lever, (c) a first and a second terminals fixed to said carrier plate and electrically connected to each other through said inversion leaf spring, and (d) an actuator lever pivotally supported by said carrier plate and adapted to press said inversion leaf spring in response to the movement of said switch lever; and a coiled spring disposed between said switch lever and said actuator lever.

2. A push button switch as claimed in claim 1, wherein said switch lever is provided with a projection for retaining one end of said coiled spring, while said actuator lever is povided with a member for retaining the other end of said coiled spring.

3. A push button switch as claimed in claim 1, wherein said carrier plate of said switch block is provided with first and second surfaces, and a through bore intercommunicating said first and second surfaces.

4. A push button switch as claimed in claim 3, wherein said inversion spring member is secured to said first surface of said carrier plate, while said first and second terminals are secured to said second surface of said carrier plate.

5. A push button switch as claimed in claim 4, wherein said actuator lever is secured at its one end to said first surface side of said carrier plate and pivotally supported at its other end by said carrier plate so as to be located at the second surface side of said carrier plate, whereby said one end depresses said inversion leaf spring as said other end is displaced in response to the depression of said switch lever.

6. A push button switch as claimed in claim 5, wherein said actuator lever extends through said through bore, so as to be pivoted to said carrier plate.

7. A push button switch comprising:

a frame;

a switch lever having a projection;

a first switch block accomodated by said frame and including, (a) a carrier plate, (b) an inversion leaf spring member made of an electrically conductive material and secured to said carrier plate so as to extend in parallel with the direction of movement of said switch lever, (c) a first and a second terminals fixed to said carrier plate and electrically insulated from each other, and (d) an actuator lever pivotally secured to said carrier plate and adapted to press said inversion leaf spring member in response to the movement of said switch lever, a second switch block accomodated by said frame and including, (a) a carrier plate, (b) a contact member including a leaf spring attached to said carrier plate and adapted to be displaced upon engagement with said projection of said switch lever, and (c) a first and a second terminals fixed to said carrier plate and adpated to be electrically connected to each other through said contact member; and a coiled spring disposed between said switch lever and said actuator lever.

8. A push button switch as claimed in claim 7, characterized in that at first said first switch block is actuated and then said second switch block is actuated, as said switch lever is depressed.

9. A push button switch as claimed in claim 7, wherein said switch lever is positioned between said first and second switch blocks in said frame.

10. A push button switch as claimed in claim 1 or 7, characterized by further comprising a bottom plate and a rubber seat provided on said bottom plate, said rubber seat being adapted to be contacted by the lower end of said actuator as said switch lever is depressed.

11. A push button switch as claimed in claim 1 or 7, characterized by further comprising a bottom plate, and a pair of arms mounted on said bottom plate and adapted to resiliently engage said frame.

* * * * *